US008146910B2

(12) United States Patent
Heierli

(10) Patent No.: US 8,146,910 B2
(45) Date of Patent: Apr. 3, 2012

(54) CONVEYING DEVICE FOR FEEDING PRINTED PRODUCTS TO A PROCESSING UNIT

(75) Inventor: Ernst Heierli, Frauenfeld TG (CH)

(73) Assignee: Muller Martini Holding AG, Hergiswil (CH)

( * ) Notice: Subject to any disclaimer, the term of this patent is extended or adjusted under 35 U.S.C. 154(b) by 210 days.

(21) Appl. No.: 11/408,151

(22) Filed: Apr. 20, 2006

(65) Prior Publication Data

US 2006/0237892 A1 Oct. 26, 2006

(30) Foreign Application Priority Data

Apr. 22, 2005 (EP) ..... 05405310

(51) Int. Cl.
*B65H 83/00* (2006.01)

(52) U.S. Cl. ..... 271/3.12; 271/3.01; 271/151; 271/270; 271/10.01

(58) Field of Classification Search ..... 271/3.01, 271/3.03, 3.12, 10.01, 225, 270, 149, 150, 271/151
See application file for complete search history.

(56) References Cited

U.S. PATENT DOCUMENTS 3,945,633 A * 3/1976 Knopp ..... 271/3.12
4,076,231 A * 2/1978 Kutzner et al. ..... 493/342
4,366,955 A * 1/1983 Pessina et al. ..... 271/7
4,447,052 A * 5/1984 Muller ..... 271/280
4,588,180 A * 5/1986 Ballestrazzi et al. ..... 271/5
4,618,136 A * 10/1986 Pessina et al. ..... 271/150
5,249,788 A * 10/1993 Helmstadter ..... 271/10.07
6,017,029 A * 1/2000 Bates et al. ..... 271/3.12
6,220,590 B1 * 4/2001 Bates et al. ..... 271/3.01
6,461,102 B2 * 10/2002 Sting et al. ..... 414/798.9
6,619,647 B2 * 9/2003 Post et al. ..... 271/3.01
6,702,281 B2 * 3/2004 Post et al. ..... 271/258.01

FOREIGN PATENT DOCUMENTS

| | | |
|---|---|---|
| DE | 101 35 661 | 2/2003 |
| EP | 0 529 490 | 3/1993 |
| JP | 56028136 | 3/1981 |
| JP | 2003072981 | 3/2003 |

* cited by examiner

*Primary Examiner* — Kaitlin Joerger
*Assistant Examiner* — Ernesto Suarez
(74) *Attorney, Agent, or Firm* — Lucas & Mercanti, LLP; Klaus P. Stoffel

(57) ABSTRACT

A conveying device for feeding printed products to a processing unit in which the printed products are conveyed along a conveying path by a first conveyor, from a stack in which the printed products are arranged vertically, to a second conveyor which has a higher circumferential speed than the first conveyor for forming an imbricated formation which is upwardly offset, wherein a holding-down device which acts on the printed products and is formed of at least one endless traction unit is arranged in a transition area formed by the conveying end of the first conveyor and the conveying beginning of the second conveyor.

8 Claims, 2 Drawing Sheets

CONVEYING DEVICE FOR FEEDING PRINTED PRODUCTS TO A PROCESSING UNIT

BACKGROUND OF THE INVENTION

1. Field of the Invention

The present invention relates to a conveying device for feeding printed products to a processing unit. In this device, the printed products are conveyed along a conveying path by means of a first conveyor, from a stack in which the printed products are arranged vertically, to a second conveyor which has a higher circumferential speed than the first conveyor for forming an imbricated formation which is upwardly offset, wherein a holding-down device which acts on the printed products and is formed of at least one endless traction means is arranged in a transition area formed by the conveying end of the first conveyor and the conveying beginning of the second conveyor.

2. Description of the Related Art

Devices of the above-described type are used for feeding printed products in businesses which further process printed products to gathering machines, gather-stitchers and insertion machines. Printed products are products such as printed sheets, cards, CD/DVD-ROM, large-surface product samples, etc., whose dimensions may vary within a wide range.

For this purpose, the printed products to be processed are loaded onto the conveying device. Depending on the type of delivery of the printed products, loading takes place, for example, manually or by means of lifting tools. Subsequently, the printed products are placed in the form of a horizontal stack with one of the side edges onto an essentially horizontally extending first conveyor which feeds the printed products as necessary to a subsequently connected second conveyor. This second conveyor has the purpose of converting the stack-shaped formation of the printed products on the first conveyor into an imbricated formation, and to feed the printed product subsequently in this preferred formation to a magazine of a processing unit. For this purpose, the first conveyor forms with the second conveyor an obtuse angle and the speed of the second conveyor is substantially higher than that of the first conveyor. The imbricating function is based on the friction principle. The aim is to form an imbricated formation which is as uniform as possible in order to achieve the best conditions for an optimum operation of the feeder of the processing unit. The uniformity should be such that printed sheets which are resting against each other are at least shifted relative to each other and no gaps are created in the imbricated formation. In addition, the printed products may not be pulled obliquely in relation to the conveying device while the imbricated formation is being formed. The formation of the imbrication from the horizontal stack into a conveying device is the central function. To achieve this, additional organs and functions are necessary for supporting the effect of the two conveyors. In the end area of the first conveyor it is possible to provide on both sides of the stack further conveying units in the form of rollers, tapes or chains which slightly upset or pre-separate the printed products transversely of the conveying direction. In addition, in conveying devices according to the state of the art, a holding-down device is provided composed of several circumferentially traveling traction means which extend beyond the end area of the first conveyor or up to the inclined front section of the second conveyor, wherein the printed products are grasped at their upper side edges and pressed against the lower conveying element of the first conveyor and the front section of the second conveyor. The conveying plane formed by the first conveyor is fixedly defined, so that inevitably the holding-down device must be adapted to the height of the printed products and also to the thickness of the produced imbricated formation. In a holding device according to the prior art, this results in an adjustment of the position of the holding-down device in the direction of two axes. However, this adjustment is time-consuming and critical because it significantly influences the imbricated formation. In addition, due to changes of the speed conditions between the first and second conveyor, the conveyors must be adapted to the changing circumstances, for example, while the thickness of the imbricated stream changes due to changes of the speed conditions between the first and second conveyors.

SUMMARY OF THE INVENTION

Therefore, it is the primary object of the present invention to construct the holding-down device in such a way that it is no longer necessary to adjust the device when the height of the printed products changes and the thickness of the imbricated stream changes, so that the device can automatically adapt to the changing operating conditions.

In accordance with the present invention, this object is met in a conveying device of the above-described type by providing the traction means at least in the transition area with a work portion which is freely placed on the printed products.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
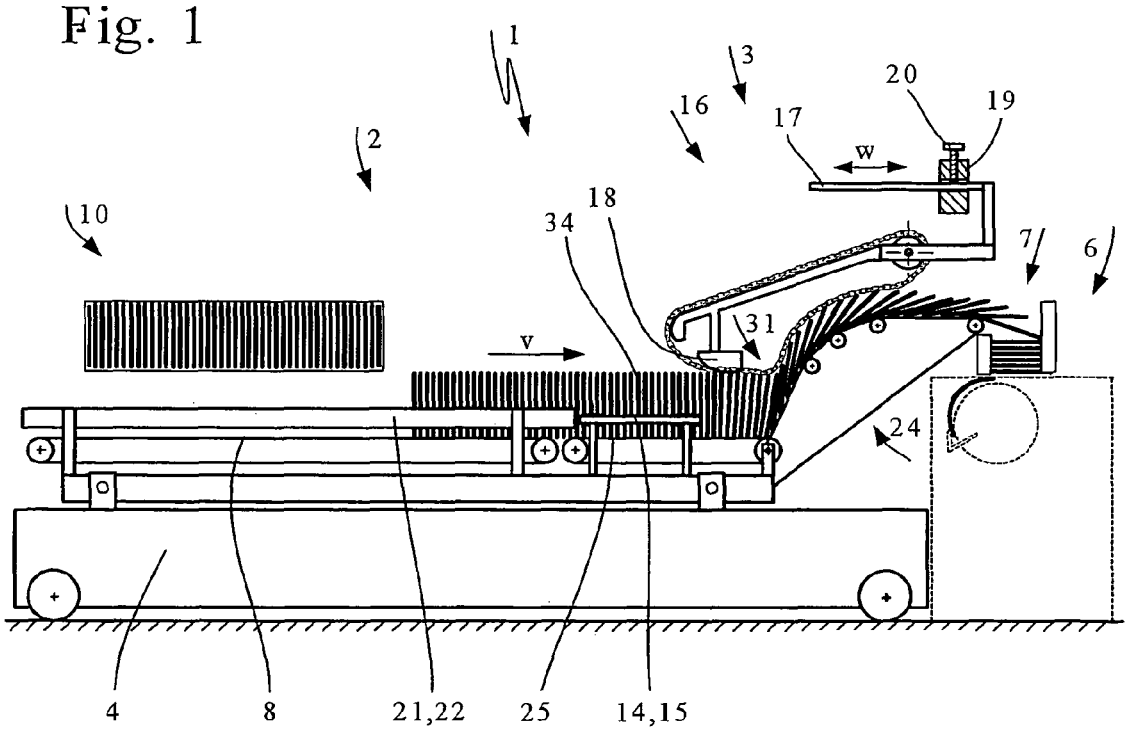
FIG. 1 is a side view of a conveying device.
Figure 2:
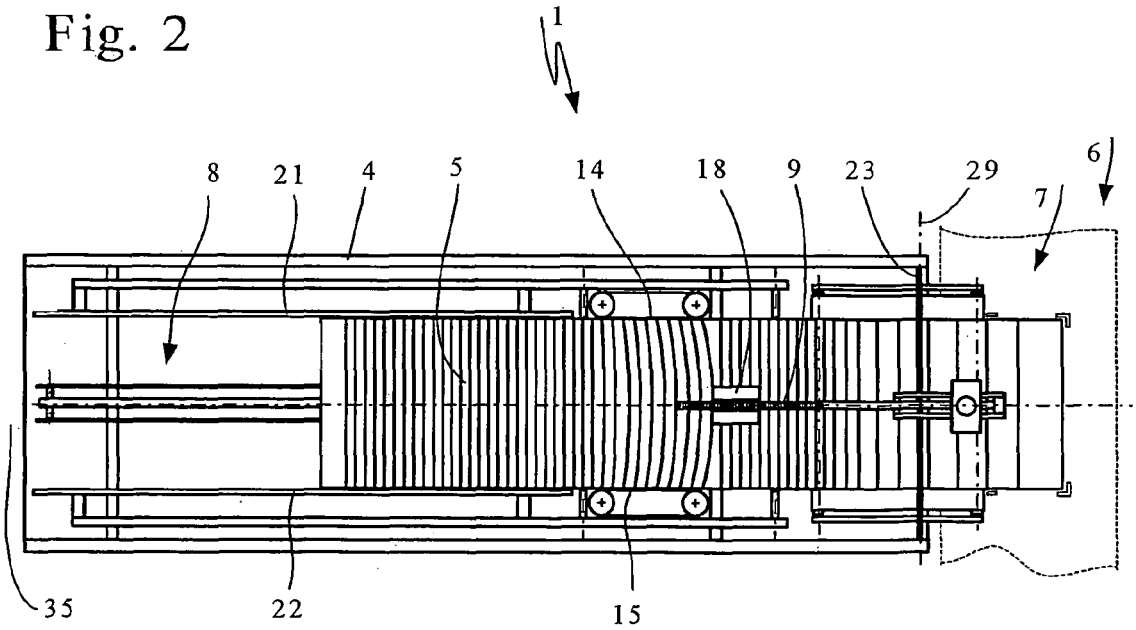
FIG. 2 is a top view of the conveying device of FIG. 1.
Figure 3:
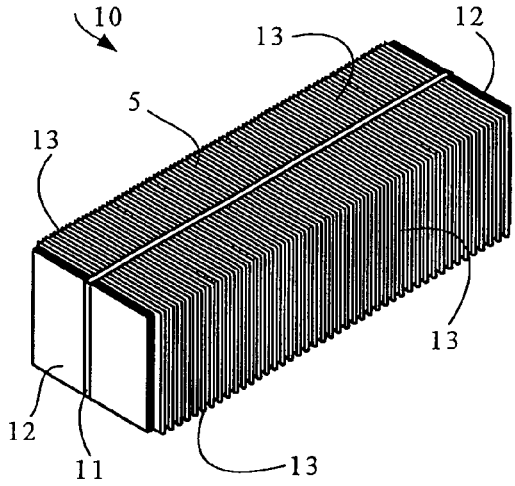
FIG. 3 is perspective view of a stack of the printed products surrounded by rings.
Figure 4:
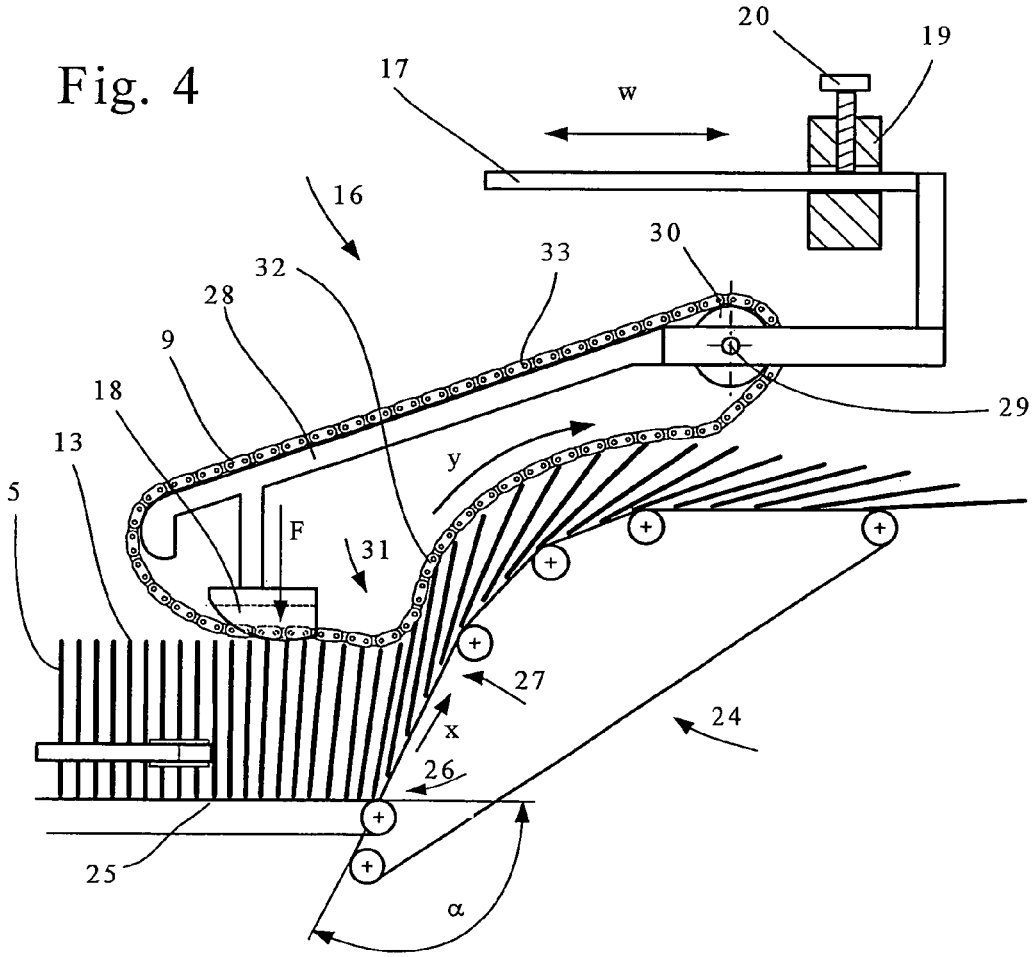
FIG. 4 is an illustration on a larger scale of a detail of FIG. 1.

FIGS. 1 and 2 of the drawing show a conveyor device 1 which includes a first conveyor 2 and a second conveyor 3, as well as a processing unit 6 whose magazine 7 is fed with printed products 5 by the conveying device 1. The printed products 5 are initially supplied in the form of stacks 10 surrounded by rings, as seen in FIG. 3, and are loaded onto the first conveyor 2. A stack 10 corresponds to a long stack of printed products 5 which is at both ends thereof closed off by an end board 12 and is provided with a ring 11. Further, it is also conceivable to load the printed products 5 as loose stacks either manually or by means of handling systems.

After being loaded, the printed products 5 rest with one of their side edges 13 on a first circumferentially driven conveyor means 8 of the first conveyor 2. Natural guide elements 21, 22 facilitate placing the printed products 5 in the correct lateral position and prevent a lateral displacement during the conveyance in the directions v. In the end area of the first conveyor 2, the printed products 5 are lightly clamped by means of driven conveyors 14, 15 and are further transported approximately with the speed of the conveying means 8 in the direction v. This type of transportation deforms the printed products 5 into the shape of an arc and any adherence present between the individual printed products 5 is reduced. At the end of the first conveyor 2, the printed products 5 rest with their flat sides at least in the area of the middle axis 35 thereof against the lower conveyor member 24 of the second conveyor 3, for example, a belt conveyor. The conveying direction v of the first conveyor 2 forms with the conveying direction 1*x* of the second conveyor 3 an obtuse angle alpha. In the lower area 26, a compression force increase takes place as a result of the conveying effect of the conveying elements 25 of the first conveyor 2 which pushes the printed products 5 forwardly against the lower conveyor member 24. In the upper area 27, the correction means 9, for example, a chain, presses the printed products 5 against the lower conveyor member 24 by means of the traction means which forms a holding-down device 16. As soon as the frictional forces between the frontmost printed product 5 which is still on the conveyor element 25 and the lower conveyor member 24 and the printed products 5 which are already unmoving in the direction x are greater than the frictional force between the frontmost printed product and the second frontmost printed product 5, the frontmost printed product 5 also begins to move in the direction x. The conveying effects of the holding-down device 16 and the lower conveying member 24 on the printed products 5 are exclusively based on frictional forces. The normal forces required for building up these frictional forces are applied essentially by the holding-down device 16. The traction means 9 of the holding-down device 16 is driven in the direction y through a drive reel 30 attached to a shaft 23. The speed of the holding-down device 16 is at least as fast as the speed of the lower conveyor member 24. The shaft 23 is rotatably mounted in the foundation 4 and is driven by a drive which is not illustrated. The auxiliary portion 33 of the traction means 9 slides due to its own weight on the traction means guide unit 28 in the direction of the first conveyor 2 and rests at that location because of its own weight on the upper side edge 13 of the printed products 5. At least one sliding shoe 18 is fastened to the traction means guide 28 which rest permanently on a upper lateral ducts 13 of the printed products 5 in the first conveyor 2 and, thus, serve to maintain constant the position of the traction means guide 28 relative to the upper side edges 13 of the printed products 5.

It is conceivable to provide a freely rotatable wheel instead of the slide shoe 18, wherein the freely rotatable wheel rolls on the upper side edges 13 of the printed products 5 and is supported on the traction means guide 28. The traction means guide 28 is freely mounted. A preferred embodiment of mounting is obtained if the traction means guide 28 is placed on the shaft 23 and, thus, can pivot about the axis 29 of the shaft 23.

However, other positions of the pivoting axis 29 are also conceivable. When processing printed products 5 with appropriate properties, it may be useful to change the resting force F of the slide shoe 18. For this purpose, a weight 19 is provided which can be moved in the direction w on a lever 17 which is fixedly connected to the traction means guide 28. In the selected position, the lever can be secured by means of a locking means 20, for example, a locking screw. Depending on whether the center of gravity of the weight 19 is located to the left or right above the axis 29, the resting force F of the slide issue 18 is increased or decreased. Instead of using weights, the same effect could also be achieved, for example, by the use of all types of spring elements, pneumatic cylinders or electric drives. The solution according to the present invention is distinguished by a simple operation and a self-adjustment of the holding-down device depending on the location of the upper side edges of the printed product 5 which depends on the size of the printed products and of the thickness of the resulting stream. The bending-soft traction means can rest against any selected formation of the upper lateral edges 13 of the printed products 5 in the transition area 31 and an advantageous distribution of the resting forces of the traction means 9 on the printed products 5 is achieved.

While specific embodiments of the invention have been shown and described in detail to illustrate the inventive principles, it will be understood that the invention may be embodied otherwise without departing from such principles.

I claim:

1. A conveying device for feeding printing products to a processing unit, the conveying device comprising:

means for conveying the printed products along a conveying path by a first conveyor, from a stack in which the printed products are arranged vertically, to a second conveyor having a higher circumferential speed than the first conveyor, for forming an imbricated formation which is upwardly offset;

wherein a holding-down device configured to act on the printed products and comprising at least one endless traction means is arranged in a transition area formed by a conveying end of the first conveyor and a conveying beginning of the second conveyor, the traction means extending from the conveying beginning to the conveying end of the transition area;

wherein the traction means at least in the transition area is comprised of a work portion freely placed on the printed products only with the weight of the traction means so as to prevent sticking together of the printed products while permitting easy fanning-out of the folded stream to facilitate separation, the conveying means, the traction means and the hold-down device being arranged to automatically accept printed products of different heights and overlapping streams of different thickness, and further comprising a traction means guide arranged above the work portion, wherein an auxiliary portion of the traction means is guided by the traction means guide, wherein the traction means guide is adjustable to height of a stack of printed products conveyed on the first conveyor, the traction means guide comprising a sliding shoe or a freely rotatable wheel, wherein the shoe rests on the stack or wherein the freely rotatable wheel rolls on upper side edges of the printed products.

2. The device according to claim 1, comprising means for applying a force on the stack via the sliding shoe or the freely rotatable wheel.

3. The device according to claim 2, wherein the force is adjustable.

4. The device according to claim 3, wherein the traction means guide is pivotal about an axis of a shaft that is rotatably mounted in a foundation of the conveying device, the means for applying a force including a lever fixedly connected to the traction means guide and a weight provided on the lever above the axis, the weight having a center of gravity that is movable in a direction along the lever so as to adjust the force.

5. The device according to claim 1, wherein the traction means guide comprises at one end thereof a drive wheel.

6. The device according to claim 5, wherein the traction means guide is rotatable about the axis of a shaft of the drive wheel.

7. The device according to claim 1, wherein the traction means is comprised of a chain.

8. The device according to claim 1, wherein the traction means is driven by a motor.

* * * * *